US005470119A

United States Patent [19]

Huf

[11] Patent Number: 5,470,119

[45] Date of Patent: Nov. 28, 1995

[54] FLEXIBLE REMOVABLE CARRYING HARNESS

[76] Inventor: Gerald D. Huf, 36 Jackson Ave., Meadville, Pa. 16335

[21] Appl. No.: 328,763

[22] Filed: Oct. 24, 1994

[51] Int. Cl.[6] ..... A45F 5/10; B65D 63/18

[52] U.S. Cl. ..... 294/157; 294/145

[58] Field of Search ..... 294/137, 145, 294/149, 150, 153, 154, 155, 157; 15/327.5, 329

[56] References Cited

U.S. PATENT DOCUMENTS

| | | | |
|---|---|---|---|
| 187,716 | 2/1877 | Kirk . | |
| 873,044 | 12/1907 | Hanson | 294/157 |
| 1,060,257 | 4/1913 | Humphrey | 294/157 |
| 1,141,005 | 5/1915 | Reifsnyder . | |
| 2,744,668 | 5/1956 | Henigman . | |
| 2,922,558 | 1/1960 | Harvey . | |
| 3,278,097 | 10/1966 | Duckworth | 294/154 |
| 3,456,280 | 7/1969 | Brown et al. . | |
| 3,599,273 | 8/1971 | Shirayanagi | 15/327.5 |
| 4,127,223 | 11/1978 | Uchin | 294/150 |
| 4,529,240 | 7/1985 | Engel . | |
| 5,040,263 | 8/1991 | Gühne et al. . | |

FOREIGN PATENT DOCUMENTS

| | | | |
|---|---|---|---|
| 1403626 | 10/1968 | Germany | 294/149 |

*Primary Examiner*—Dean Kramer
*Attorney, Agent, or Firm*—Richard C. Litman

[57] ABSTRACT

A carrying harness for carrying cleaning apparatuses having casters at their bottom surface including a handle member, two lateral support members, two transverse members, and loops at the ends of the transverse members for engaging the casters. When the loops at the ends of the transverse members are slipped around the casters, the cleaning apparatus can be lifted by pulling on the handle member. In an alternative embodiment, the handle member includes a snap having a spring biased closure. This enables easier removal of the harness from the cleaning apparatus. The alternative embodiment may or may not include the lateral support members.

8 Claims, 3 Drawing Sheets

FLEXIBLE REMOVABLE CARRYING HARNESS

BACKGROUND OF THE INVENTION

1. Field of the Invention

The present invention relates to a flexible, removable carrying harness for allowing cleaning equipment such as canister vacuums, carpet steam cleaners, liquid filtration vacuum cleaners, liquid spray carpet cleaners, and the like to be easily and conveniently carried around the house.

2. Description of the Prior Art

Many types of cleaning equipment such as canister vacuums, carpet steam cleaners, liquid filtration vacuum cleaners, liquid spray carpet cleaners, and the like, on the market today, do not have any provision for easy and convenient carrying of the unit when it is in its operational configuration. Often times the carrying handle provided for the unit can only be used when the unit is partially disassembled. This drawback is a major inconvenience for the user of the unit. For example, the user, when attempting to take the unit upstairs to clean the upstairs area, must first disassemble the unit, carry the various parts up the steps, and then reassemble the unit upstairs before proceeding with the cleaning operation. Therefore, it is desirable to have a means for easy and convenient carrying of cleaning units of the type mentioned above, for example when carrying the unit upstairs or around other obstacles around the house, without having to disassemble such cleaning units.

U.S. Pat. No. 187,716, issued to Kirk, shows a carrying strap having a rigid cross member and two transversely mounted buckled straps. The Kirk patent does not show the flexible cross member of the present invention, or the four loops at the ends of the transverse members of the present invention.

U.S. Pat. No. 1,141,005, issued to Reifsnyder, shows a carrying strap for fruits such as watermelons having a rigid handle and four transverse straps each having two spikes at the end for insertion into the fruit. The Reifsnyder patent does not show the flexible cross member of the present invention, or the four loops at the ends of the transverse members of the present invention.

U.S. Pat. Nos. 2,744,668 issued to Henigman and 2,922,558 issued to Harvey, show carrying devices for thermos bottles having two circular clamping members joined by a rigid handle member. The Henigman and Harvey patents do not show the flexible cross member of the present invention, or the four loops at the ends of the transverse members of the present invention.

U.S. Pat. No. 3,456,280 issued to Brown et al. shows a vacuum cleaner having a cord winder and a wire harness for electrically connecting various parts of the vacuum cleaner. The wire harness of the Brown et al. patent is not intended for carrying at all, but is rather intended for electrically connecting various parts of the vacuum cleaner. Further, The Brown et al. patent does not show the flexible cross member of the present invention, or the four loops at the ends of the transverse members of the present invention.

U.S. Pat. No. 4,529,240 issued to Engel, shows a carrying harness for dragging a deer carcass through the woods. The Engel patent shows four loops disposed at the ends of two transverse members. The transverse members are connected by a flexible cross member. The four loops of the Engel carrying harness are not substantially symmetrically disposed about the cross member. Therefore the Engel harness could not function as a carrying harness for the types of cleaning equipment mentioned above. Further the cross member in the Engel harness is not suitable as a carrying handle because of the coiled portion in its middle which is intended for engaging the horn of a saddle mounted on a horse.

U.S. Pat. No. 5,040,263 issued to Gühne et al., shows a belt worn around the waist for carrying a vacuum cleaner hose. The Gühne et al. patent does not show the flexible cross member of the present invention, or the four loops at the ends of the transverse members of the present invention.

None of the above inventions and patents, taken either singly or in combination, is seen to describe the instant invention as claimed.

SUMMARY OF THE INVENTION

The present invention is a carrying harness for carrying a cleaning apparatus such as canister vacuums, carpet steam cleaners, liquid filtration vacuum cleaners, liquid spray carpet cleaners, and the like, around the house and up the steps without having to disassemble the cleaning apparatus. The carrying harness of the present invention has a handle member and two transverse members provided with a loop at each end.

Accordingly, it is a principal object of the invention to allow the easy carrying of a cleaning apparatus without having to disassemble the cleaning apparatus.

It is another object of the invention to provide a carrying harness that is easy to attach to the cleaning apparatus without any modification to the cleaning apparatus.

It is a further object of the invention to provide a carrying harness that can easily and quickly be removed from the cleaning apparatus.

Still another object of the invention is to provide a carrying harness that can be applied to the cleaning apparatus while minimizing the possibility of any damage thereto.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
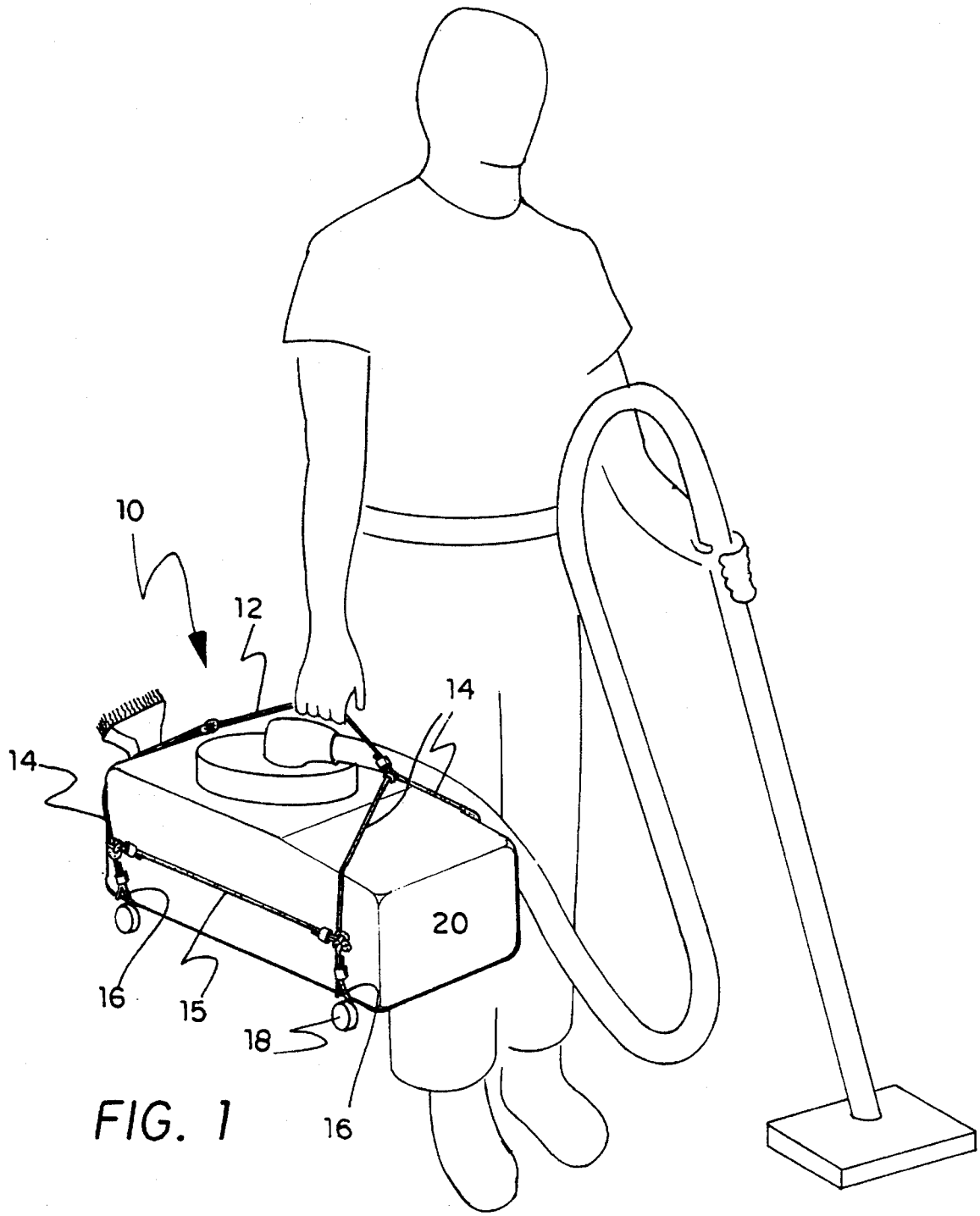
FIG. 1 is an environmental perspective of the carrying harness of the present invention.
Figure 2:
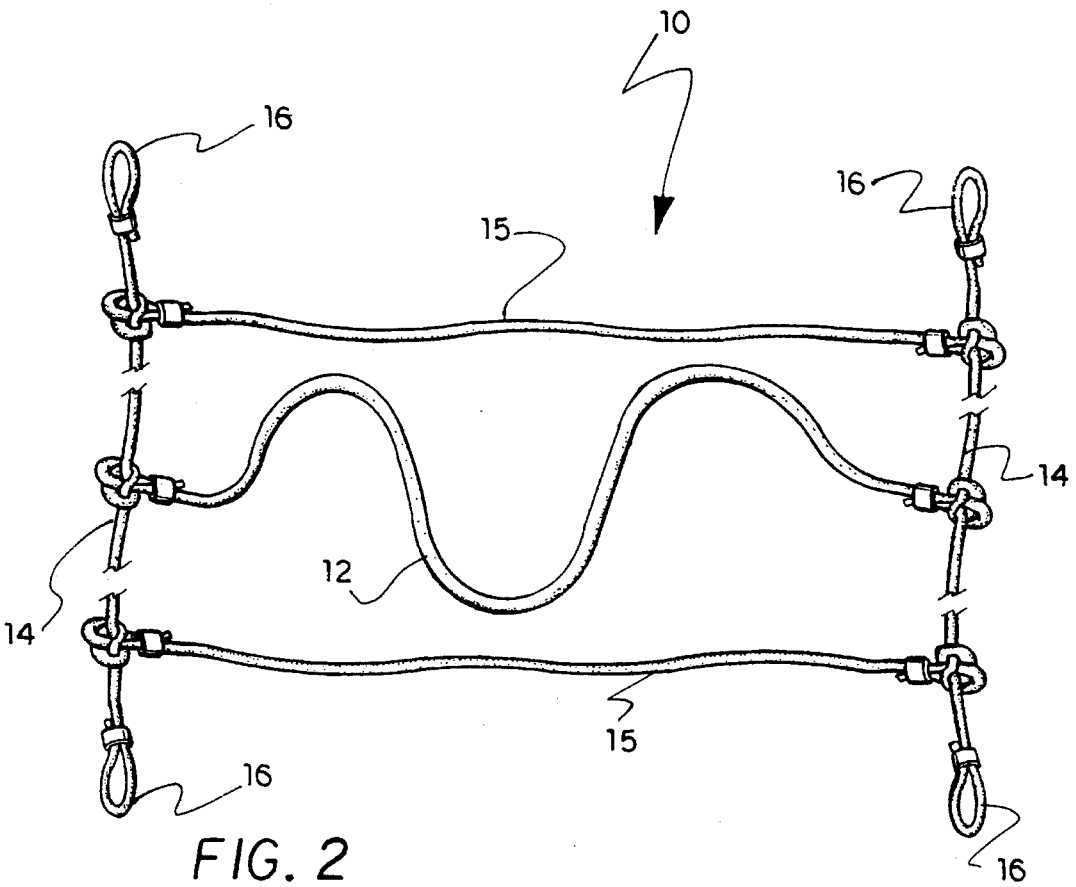
FIG. 2 is a plan view of the carrying harness of the present invention.

Referring to FIGS. 1 and 2 the present invention is a flexible, removable carrying harness 10. The carrying harness 10 is particularly suited for carrying cleaning apparatuses such as canister vacuums, carpet steam cleaners, liquid filtration vacuum cleaners, liquid spray carpet cleaners, and the like, which normally have four casters provided at each corner of the bottom surfaces thereof. An example of such an apparatus is the Thermax® home unit cleaning system which has a caster provided at each corner of its bottom surface to allow the cleaning system to be rolled along on the floor.

The carrying harness 10 includes a handle member 12, two transverse members 14, two lateral support members 15, and four loops 16, with one loop 16 provided at each free end of the transverse members 14. The carrying harness 10 is preferably made of ¼" hollow nylon rope. Each loop 16 is large enough for a caster 18 of the cleaning apparatus 20 to fit through. In addition, the handle member 12 may be provided with a padded portion in order to allow the cleaning apparatus to be carried more comfortably.

In use each loop 16 is slipped around a respective caster 18. When the weight of cleaning apparatus is supported by the carrying harness the loops 16 are pulled tightly about the attachment of the casters to the cleaning apparatus, and therefore the loops 16 will not slip off the casters 18 while the cleaning apparatus is being carried. The loops 16 can be formed in any conventional manner known for forming a loop on the end of a piece of rope.

In use the handle member 12 generally extends parallel to the longitudinal axis of the cleaning apparatus 20. The handle member 12 is positioned directly above the center of gravity of the cleaning apparatus 20 so that the cleaning apparatus 20 will not tilt when supported by the harness 10. This is especially important when the cleaning apparatus 20 has a liquid reservoir since tilting the cleaning apparatus may cause the liquid to spill. Lateral support members 15 provide additional support on either side of the cleaning apparatus 20 to keep the cleaning apparatus from tilting.

The transverse members 14 extend transversely to the longitudinal axis of the cleaning apparatus 20. The transverse members 14 are attached at about their midpoint to respective ends of the handle member 12. Also respective ends of lateral support members 15 are attached to the transverse members 14, between the attachment points of the handle member 12 and the loops 16, in such a location as to allow the lateral support members 15 to extend along either side of the cleaning apparatus 20.

The transverse members 14 can be attached to respective ends of the handle member 12 in any convenient manner so long as any movement of the ends of the handle member 12 along the respective transverse member 14 is prevented. For example, the ends of the handle member 12 may be formed into loops, the respective transverse members 14 threaded therethrough, and the transverse members 14 tied around the portions of the handle member 12 formed into loops. The details of the attachment of the handle member 12 to the transverse members 14 are not shown since such types of attachment are well known. Lateral support members 15 are attached to the transverse members 14 in a manner similar to the attachment of the handle member 12 to the transverse members 14.

There is sufficient slack in transverse members 14 and loops 16 such that when the weight of the cleaning apparatus 20 is no longer supported by the carrying harness 10, the loops 16 can slip off the casters 18, and thus the carrying harness 10 can easily be removed.

Figure 3:
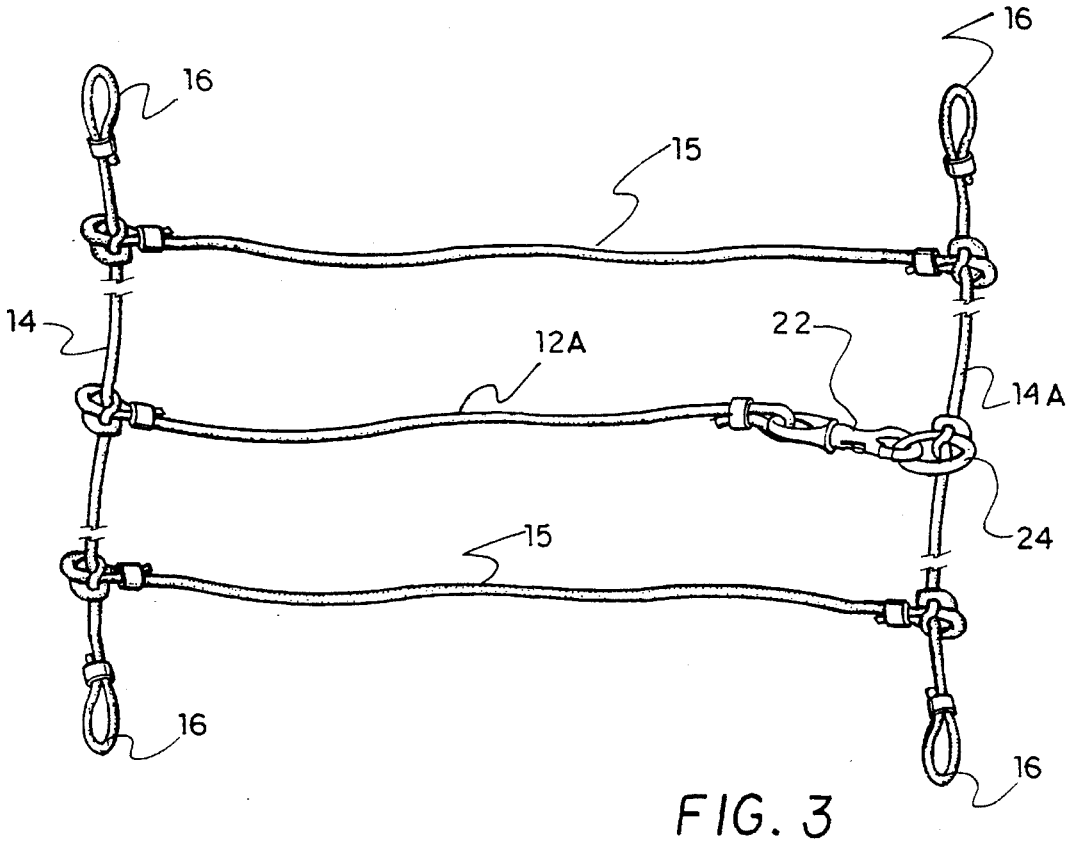
FIG. 3 is a plan view of a second embodiment of the carrying harness of the present invention.

Referring to FIG. 3, a second embodiment of the carrying harness of the present invention is shown. In this embodiment the handle member **12*a* is releasably attached to one of the transverse members 14*a*. In the example shown in FIG. 3, a snap with a conventional spring biased closure 22 engages a ring 24 to which the transverse member 14*a* is secured. The snap 22 and the ring 24** are of the type commonly used to attach dog leashes to dog collars, and are preferably made of nickel or chrome plated brass.

Handle member **12*a* is shorter than handle member 12 of the first embodiment, because less slack is required to remove the carrying harness 10 due to the detachable nature of handle member 12*a***.

Figure 4:
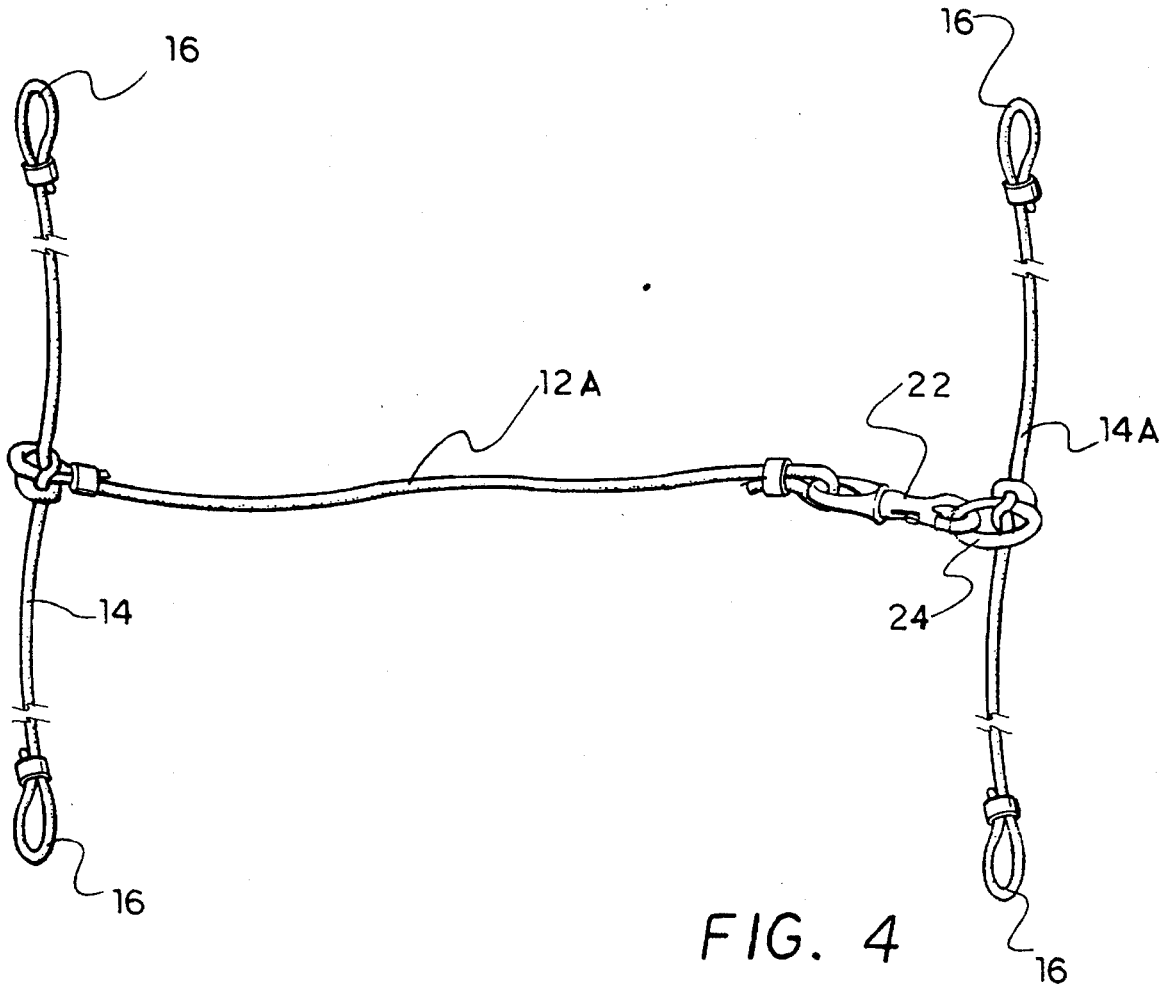
FIG. 4 is a plan view of a third embodiment of the carrying harness of the present invention.

Referring to FIG. 4, a third embodiment of the carrying harness of the present invention is shown. The third embodiment differs from the second embodiment, only in that the third embodiment lacks the lateral support members 15. It would be appreciated by a person skilled in the art that, although lateral support members 15 provide added stability when carrying the cleaning apparatus 20, they are not strictly necessary for the proper functioning of the carrying harness 10.

It is to be understood that the present invention is not limited to the embodiments described above, but encompasses any and all embodiments within the scope of the following claims.

I claim:

1. A carrying harness for carrying a cleaning apparatus having casters disposed at the bottom thereof, comprising:

a handle member having first and second ends;

a first transverse member having first and second free ends, said first transverse member being attached to said first end of said handle member;

a second transverse member having first and second free ends, said second transverse member being attached to said second end of said handle member, each of said first free end of said first transverse member, said second free end of said first transverse member, said first free end of said second transverse member, and said second free end of said second transverse member being provided with a loop, said loops being engageable with the casters of a cleaning apparatus, said carrying harness thereby being capable of supporting a cleaning apparatus without allowing any substantial tilting of the cleaning apparatus;

a first lateral support member having first and second ends, said first end of said first lateral support member being attached to said first transverse member between said first end of said handle member and said first free end of said first transverse member, said second end of said first lateral support member being attached to said second transverse member between said second end of said handle member and said first free end of said second transverse member; and a second lateral support member having first and second ends, said first end of said second lateral support member being attached to said first transverse member between said first end of said handle member and said second free end of said first transverse member, said second end of said second lateral support member being attached to said second transverse member between said second end of said handle member and said second free end of said second transverse member.

2. The carrying harness according to claim 1, wherein said first and second ends of said handle member are attached to said first and second transverse members respectively at about the midpoint of said first and second transverse members.

3. The carrying harness according to claim 1, wherein said loops are substantially identical in structure.

4. The carrying harness according to claim 1, wherein one of said first and second ends of said handle member is releasably attached to a respective one of said first and second transverse members.

5. The carrying harness according to claim 4, wherein said first and second ends of said handle member are attached to said first and second transverse members respectively at about the midpoint of said first and second transverse members.

6. The carrying harness according to claim 4, wherein said loops are substantially identical in structure.

7. The carrying harness according to claim 4, said handle member further comprising a releasable snap having a spring biased closure.

8. A carrying harness for carrying a cleaning apparatus having casters disposed at the bottom thereof, comprising:

a handle member having first and second ends, and further comprising a releasable snap having a spring biased closure;

a first transverse member having first and second free ends, said first transverse member being attached at about the midpoint thereof to said first end of said handle member;

a second transverse member having first and second free ends, said second transverse member being attached at about the midpoint thereof to said second end of said handle member, each of said first free end of said first transverse member, said second free end of said first transverse member, said first free end of said second transverse member, and said second free end of said second transverse member being provided with a loop, said loops being substantially identical in structure, and engageable with the casters of a cleaning apparatus, said carrying harness thereby being capable of supporting a cleaning apparatus without allowing any substantial tilting of the cleaning apparatus, and one of said first and second ends of said handle member being releasably attached to a respective one of said first and second transverse members;

a first lateral support member having first and second ends, said first end of said first lateral support member being attached to said first transverse member between said first end of said handle member and said first free end of said first transverse member, said second end of said first lateral support member being attached to said second transverse member between said second end of said handle member and said first free end of said second transverse member; and a second lateral support member having first and second ends, said first end of said second lateral support member being attached to said first transverse member between said first end of said handle member and said second free end of said first transverse member, said second end of said second lateral support member being attached to said second transverse member between said second end of said handle member and said second free end of said second transverse member.

* * * * *